US007104411B2

(12) United States Patent
Magnusson et al.

(10) Patent No.: US 7,104,411 B2
(45) Date of Patent: Sep. 12, 2006

(54) SYSTEM FOR DETACHABLE SUSPENSION OF SHELVES, DRAWERS OR THE LIKE

(75) Inventors: Reine Magnusson, Västervik (SE); Peter Nilsson, Västervik (SE)

(73) Assignee: Elfa Sweden AB, Västervik (SE)

( * ) Notice: Subject to any disclaimer, the term of this patent is extended or adjusted under 35 U.S.C. 154(b) by 0 days.

(21) Appl. No.: 10/380,063

(22) PCT Filed: Oct. 25, 2002

(86) PCT No.: PCT/SE02/01942

§ 371 (c)(1),
(2), (4) Date: Jul. 23, 2003

(87) PCT Pub. No.: WO03/034867

PCT Pub. Date: May 1, 2003

(65) Prior Publication Data

US 2004/0020884 A1 Feb. 5, 2004

(30) Foreign Application Priority Data

Oct. 26, 2001 (SE) ..... 0103570

(51) Int. Cl.
*A47F 5/08* (2006.01)

(52) U.S. Cl. ..... 211/90.01; 211/187; 211/193; 248/301; 248/316.8

(58) Field of Classification Search ..... 211/90.01, 211/90.02, 90.03, 90.04, 134, 153, 108, 102, 211/106, 106.01, 187, 190, 207, 193; 108/108, 108/102; 248/300, 301

See application file for complete search history.

(56) References Cited

U.S. PATENT DOCUMENTS

| | | | | | |
|---|---|---|---|---|---|
| 3,648,626 | A | * | 3/1972 | Schuster | 108/42 |
| 3,993,002 | A | * | 11/1976 | Stroh | 108/108 |
| 4,589,349 | A | * | 5/1986 | Gebhardt et al. | 108/102 |
| 4,720,069 | A | * | 1/1988 | Bessinger | 248/250 |
| 4,730,738 | A | * | 3/1988 | Bartus et al. | 211/90.02 |
| 4,881,708 | A | | 11/1989 | Walter | |
| 5,205,524 | A | * | 4/1993 | Cohen | 248/235 |
| 5,403,083 | A | | 4/1995 | Dasher et al. | |
| 5,660,777 | A | | 8/1997 | Herrmann et al. | |
| 5,715,957 | A | * | 2/1998 | Merl | 211/187 |

(Continued)

FOREIGN PATENT DOCUMENTS

| | | |
|---|---|---|
| EP | 0 213 236 | 3/1987 |

(Continued)

*Primary Examiner*—Jennifer E. Novosad
*Assistant Examiner*—Jared W. Newton
(74) *Attorney, Agent, or Firm*—Buchanan, Ingersoll & Rooney PC

(57) ABSTRACT

A system for detachable suspension of shelves (5), drawers or the like from essentially vertially positioned supporting elements (1) with slots or grooves (3). Plate-shaped brackets (4) are adapted to carry said shelves (5) and, by means of hook-shaped portions (7), are adapted to be inserted into a selected slot (3) for suspension of the brackets (4) from the supporting elements (1). The system also comprises a frame (14) which carries said shelves (5) and which can be detachably fastened to a pair of neighbouring brackets (4) by means of ears (20) which protrude from the frame (14) and which are inserted into L-shaped grooves (9) in the respective brackets (4). The frame (14) is locked onto the brackets (4) by means of locking elements (21) which protrude from the frame (14) and which are moved into engagement with the grooves (9), slots (25), indentations (26) or holes (27) in the brackets (4).

12 Claims, 2 Drawing Sheets

U.S. PATENT DOCUMENTS 5,720,230 A * 2/1998 Mansfield ..... 108/108
6,019,331 A * 2/2000 Hoogland et al. ..... 248/250
6,021,908 A * 2/2000 Mathews ..... 211/90.02
6,024,333 A * 2/2000 Raasch et al. ..... 248/247
6,123,303 A * 9/2000 Huang ..... 248/241
6,164,462 A * 12/2000 Mumford ..... 211/59.2
6,234,328 B1 * 5/2001 Mason ..... 211/90.02
6,302,036 B1 * 10/2001 Carson et al. ..... 108/110
6,345,795 B1 * 2/2002 Bartz, Jr. ..... 248/247
6,364,136 B1 * 4/2002 Weshler et al. ..... 211/90.02
6,520,353 B1 * 2/2003 Fulbright ..... 211/153
6,522,551 B1 * 2/2003 Hsu et al. ..... 361/752

FOREIGN PATENT DOCUMENTS

SE 360 971 10/1973

* cited by examiner

SYSTEM FOR DETACHABLE SUSPENSION OF SHELVES, DRAWERS OR THE LIKE

BACKGROUND OF THE INVENTION

The present invention relates to a system for detachable suspension of shelves, drawers or the like from a wall or standing on the floor, comprising at least two essentially vertically positioned supporting elements with slots or grooves and plate-shaped brackets which are adapted to carry said shelves, drawers or the like and which, by means of at least one hook-shaped portion protruding from one end of each bracket, are adapted to be inserted into selected slots or grooves for suspension of the brackets from the supporting elements, at least one essentially L-shaped groove being formed in each bracket between its ends and having a first leg which extends substantially in the longitudinal direction of the bracket, and a second leg which extends from the first leg and leads to the upper portion of the bracket in its mounted position.

Systems for suspension of shelves in vertical supporting elements by means of a pair of brackets, which detachably can be attached at an optional level to the supporting elements, are already known from, for example, the leaflet "Planerings-och produktguide" ("Planning and Product Guide") of Elfa International AB. The shelves are made of wood material and are adapted to be screwed to the brackets. Apart from the inconvenience screwing involves, this also means that brackets specially designed for the shelves are required. In addition, a bracket, which usually is a metal sheet bent in the shape of a U, can only carry one end of a shelf and not the end of an adjacent shelf.

It is also known from the above-mentioned leaflet to suspend wire baskets from vertical supporting elements, but also in this case brackets which are specially designed are required since standard brackets cannot be used, see, for instance, the leaflet "SPARRING—Makes your storage !" of Elfa International AB.

In the last-mentioned leaflet and in Swedish patent application 9903969-5, a system for suspension of shelves of wire from vertical supporting elements by means of brackets which can be detachably attached to the supporting elements is shown. However, the shelves are firmly fastened to the brackets and cannot without a real effort be removed from them. Moreover, these known suspension systems are not specially suited for suspension of wire baskets or drawers.

OBJECTS AND SUMMARY

The object of the present invention is to provide a system for suspension of shelves, drawers and wire baskets from vertical supporting elements by means of brackets which allow the shelves, drawers or the like to be easily detached and removed from the brackets.

A further object of the invention is to provide a system for suspension which comprises a frame structure which carries a shelf, a drawer and the like and which can be detachably connected by means of a pair of opposite brackets so as to be a self-supporting unit displaceable in one piece.

Yet another object of the invention is to provide a suspension system having a frame structure, in which a shelf, a drawer or the like can be carried displaceably.

According to the invention these objects have been achieved by means of a suspension system as described in the introductory paragraph, which suspension system is characterised in that the system also comprises at least one frame which is adapted to carry said-shelves, drawers or the like and which frame exhibits a pair of separate and parallel sides with attaching means for detachable fastening of the frame to neighouringly arranged brackets and at least one connecting portion which connects said sides with one another and which is essentially perpendicular thereto, that each attaching means comprises at least one ear protruding from the respective said sides and outside the frame, and that each ear is adapted to be inserted so that it hooks into the first leg of the associated L-shaped groove.

Further developments of the invention will be evident from the features stated in the subclaims.

BRIEF DESCRIPTION OF THE DRAWINGS

Preferred embodiments of the invention will now be described by way of example and with reference to the accompanying drawings, in which.

DETAILED DESCRIPTION OF THE PREFERRED EMBODIMENTS

Figure 1:
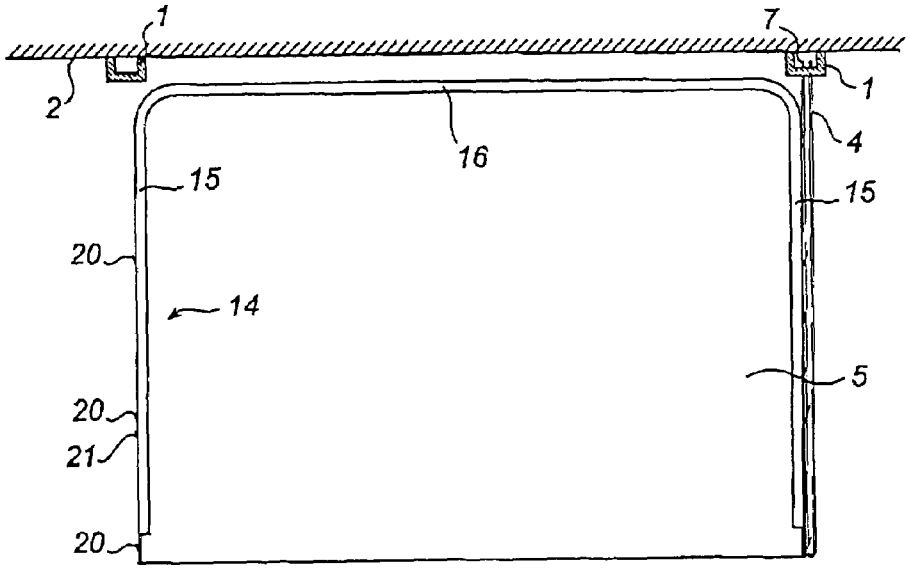
FIG. 1 is a top plan view of an embodiment of the suspension system according to the invention.

Reference is first made to FIG. 1, in which a top plan view shows a suspension system according to the invention which comprises supporting elements 1 which are known per se and are essentially vertically positioned. The supporting element can be arranged separately and carried by a pair of feet resting on a base, for example, a floor (not shown). However, it is preferred that the supporting element be a rail or a sectional element which is attached to or integrated in a wall 2. The supporting element 1 is preferably formed as a U-shaped rail which is screwed to the wall 2 or comprises a hanging rail which is suspended from a carrying strip attached to the wall, which is shown in Elfa's leaflet "Planerings—och produktguide".

The supporting element or rail 1 is provided with two parallel rows of slots or grooves 3 of the same dimension and with the same mutual distance in the longitudinal direction. Alternatively, the supporting element 1 can be provided with only one row of slots or grooves.

In the suspension system also a number of brackets 4 are included, which in pairs are adapted to detachably carry a shelf 5 or a wire drawer (not shown but illustrated in the above-mentioned leaflet) or the like. It will easily be understood that each bracket is suspended from the respective supporting elements 1 of each shelf or the like.

Figure 2:
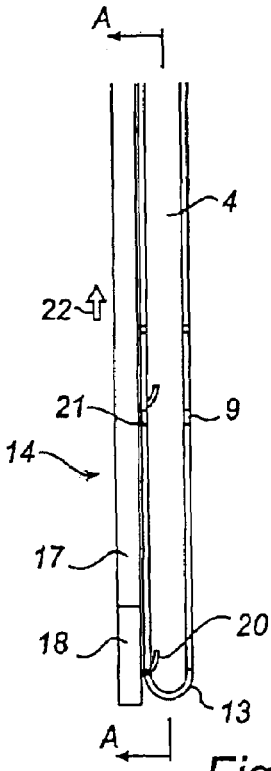
FIG. 2 shows a portion of the suspension system on an enlarged scale and in a view corresponding to that in FIG. 1.
Figure 3:
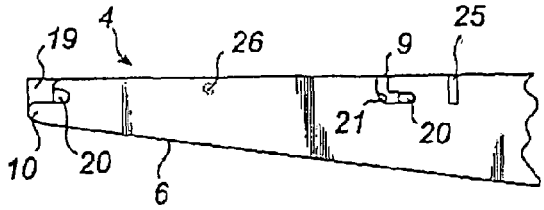
FIG. 3 is a vertical cross-sectional view along the line A—A.

The bracket is preferably made of a simple metal sheet or plate of metal or some other suitable material or a metal sheet bent in the shape of a U, or the like, cf. FIG. 2. In the last-mentioned case, the bending 6 is arranged in the lower part of the bracket 4 (in its mounted state) and its free ends in the upper part as is shown in FIG. 2.

Figure 4:
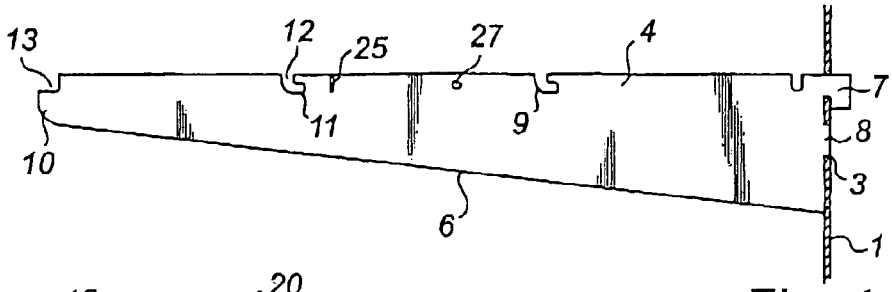
FIG. 4 is a side view of a preferred bracket which is comprised in the suspension system.

Irrespective of what form the bracket 4 has, it exhibits at its one end a respective hook-shaped, protruding portion 7 which is adapted to be inserted into a selected slot 3 in the supporting element or rail 1 and to engage with an area inside the supporting element adjacent to the slot 3 for suspension of the bracket from the supporting element, as illustrated in FIG. 4.

To be able to attach the bracket 4 more firmly to the supporting element 1, especially if the bracket is made of a simple metal sheet or plate (not bent in a U-shape), a guide lug 8 is formed in a protruding manner at the end of the bracket with the protruding portion 7 at a distance therefrom corresponding to the mutual distance of the slots 3. The guide lug 8 is adapted to be inserted into a separate slot in the supporting element 1, see FIG. 4.

Reference is made to FIG. 4, in which one, two or more L-shaped grooves 9 are formed in that portion of the bracket 4 which is located opposite to the bending 6 and between the ends of the bracket in the longitudinal direction, that is between the protruding portion 7 and its free end 10. The first leg 11 of the groove 9 extends in the longitudinal direction of the bracket 4 and its second leg 12 extends from the first leg 11 and leads to the upper portion of the bracket in FIG. 4. In the free end 10 of the bracket, there is a recess 13, the bottom of which is located at the same level as the bottom of the L-shaped groove 9 (the first leg 11).

The above-described bracket 4 is preferred in the suspension system according to the invention, but the brackets which have been indicated in said Swedish patent application 9903969-5 and the above-mentioned leaflet can also advantageously be used.

In the system according to the invention also a frame 14 is included, which carries said shelf 5, drawer or the like. The frame 14 consists of a pair of sides 15 which are parallel to one another and which are adapted to be attached to a respective neighbouring bracket 4, and a connecting portion 16 which is perpendicular to the sides 15, that is parallel to the wall 2 in FIG. 1. Preferably, the frame is made of a metal section which has been bent to said shape.

Figure 5A:
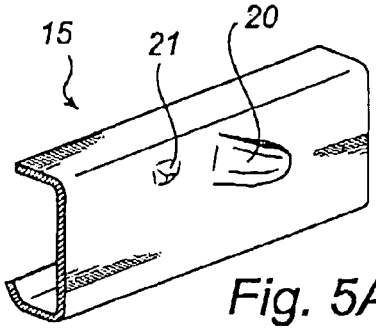
FIGS. 5A–5E illustrate alternative embodiments of the attaching means of the frame.
Figure 5B:
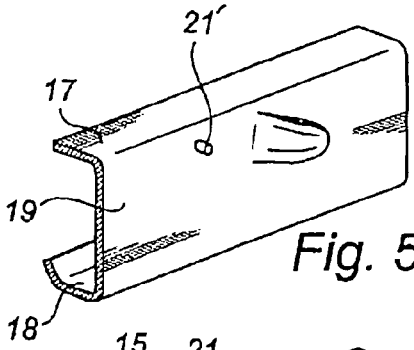
Figure 5C:
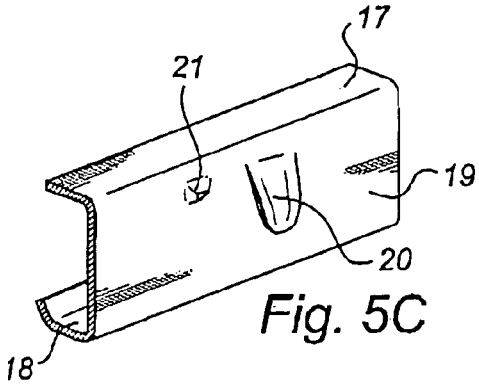
Figure 5D:
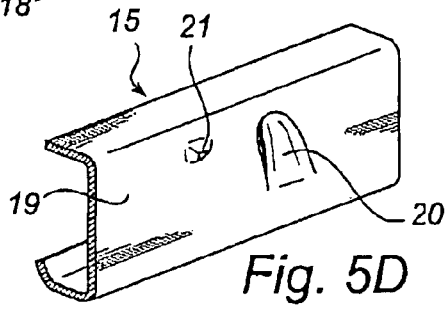

The metal section is in the illustrated embodiment essentially U-shaped in cross-section and consists of an upper flange 17, a lower flange 18 and a web 19 connecting them with one another, see FIG. 5B. In the illustrated embodiment, the shelf 5, the drawer or the like is supported by the lower flange 18 but could also be supported by the upper flange 17. It is also possible to use a section being L-shaped in cross-section, in which case preferably the upper flange 17 being eliminated. The frame 14 is shown in FIG. 1 as a U-shaped structure in the plane of the shelf 5, that is a frame with three sides. Naturally, it is possible to use a closed frame, that is a frame with four sides, which gives a frame with an essentially improved torsional stiffness. Preferably, the lower flange 18 protrudes beyond the upper flange 17 at the free ends of the sides 15 of the frame, as shown in FIG. 2, in order to facilitate the insertion of, for example, a shelf 5 in the mounted frame 14, when the shelf is to rest on the lower flange 18.

Both sides of the frame 14 are provided with attaching means for attaching the frame to a pair of brackets 4. Each attaching means comprises at least one ear 20 which protrudes from each side 15 of the frame and away from the inside of the frame. In FIG. 1 it has been shown that three ears 20 protrude from each side 15 of the frame. The ears 20 are punched in each web 19 and have a tongue-like shape, see FIGS. 5A–5E, although other shapes are possible, such as rectangular, triangular or half-oval shapes. In addition, the ears 20 are substantially parallel to the respective webs 19, see FIG. 6, or extend at an acute angle thereto. The location of the ears on the outer side 15 of the frame corresponds to the location of the groove 9 and recess 13 of the bracket, which will be discussed in the following.

In the illustrated embodiment, see particularly FIG. 1, each side of the frame has three ears 20 but, in many cases, two ears can be sufficient. Besides, each ear 20, apart from one on each side of the frame, can be replaced by a pin or the like (not shown) protruding from the side of the frame. Thus, at least one ear on each side 15 of the frame is required. The ears 20 are oriented in, or with a slight inclination towards, the plane of the frame 14, as illustrated in FIGS. 2, 3, 5A, 5B, 5E and 6. Alternatively, the ears are oriented transversely to the plane of the frame, that is, downwards according to FIG. 5C and/or upwards according to FIG. 5D.

In order to lock the frame 14 onto the associated brackets 4, each side 15 of the frame exhibits at least one locking element 21 which protrudes from the web 19 and away from the inside of the frame and which thus protrudes from the same part of the web 19 as does the ear 20, but an essentially shorter distance than does the ear. The position of the locking element 21 is defined relative to said at least one ear 20, which will be discussed in the following in connection with the mounting operation. In FIGS. 2, 3, 5A, 5C, 5D, and 6, the locking element 21 is shown as a wedge-shaped boss which is pressed in the web 19 with a sliding surface or a sliding edge 23 having a slight inclination, that is, at an obtuse angle (about 150°) to the web 19, the sliding surface or sliding edge being oriented in the direction of mounting of the frame, see arrow 22 in FIG. 2, and a locking surface or locking edge 24 having a considerable inclination, that is, essentially perpendicular to the web 19, the locking surface or locking edge being oriented opposite to the direction of mounting of the frame.

Figure 5E:
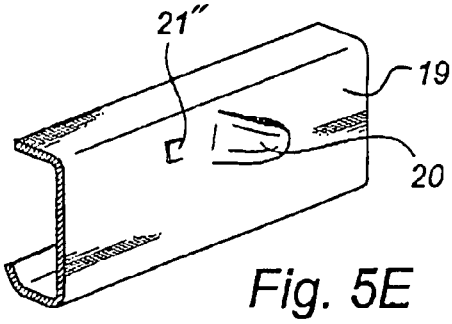
Figure 6:
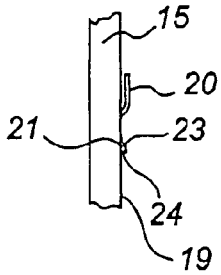
FIG. 6 is a top plan view of the attaching means according to FIG. 5A.

Although the locking element 21 presented above is preferred, the locking element can also have the shape of a short peg 21' or stud which is attached to the outside of the web 19. As illustrated in FIG. 5E, the locking element can also be formed as a tongue 21" which protrudes from the outside 15 of the frame and which is punched in the web 19 and which is similar to the ear 20 but considerably shorter and which is oriented opposite to the direction of mounting of the frame 14, cf. FIG. 2. Naturally, other shapes of locking elements are also possible, for example, a screw in a threaded hole, a rivet or a pin (not shown).

Mounting of the illustrated suspension system takes place in the following way.

After the supporting elements or rails 1 have been put into position as described above, the protruding portion 7 of the respective brackets 4 is inserted into a selected slot. The frame 14 is placed between two brackets 4, the ears 20 (and pins, if any, not shown) being inserted into the second leg 12 of the L-shaped grooves 9 and in the recess 13, until the ears 20 rest on the bottom of the first leg 11 and the recess 13, respectively. Subsequently, the frame 14 is displaced in a horizontal direction relative to the supporting elements 1, that is, in the direction of mounting 22. The locking element 21 then slides against the external surface of the bracket 4. When the ears 20 in the L-shaped grooves 9 have been displaced towards and essentially adjacent to the innermost end of the first leg 11, the locking element 21 snaps into the groove 9 and, with its locking surface 24, abuts against that side of the first leg 11 which is nearest the free end 10 of the bracket, see FIG. 3, since the locking element 21 is positioned in such a manner relative to the ear 20 that this can take place, cf. FIGS. 5A–6. Of course, the same is also applicable when the locking element is formed as a pin or a pin 21' (see FIG. 5B) or a tongue 21" (see FIG. 5E)

Although the above locking arrangement with the locking element 21 and the ear 20 co-operating in the same groove 9 is preferred, it is also possible to position the locking element at another location, that is, not co-operating with the groove 9. The locking element can thus be positioned in such a manner on the side 15 of the frame that, in connection with said displacement of the frame, it instead snaps into a slot 25 in the bracket 4 or slides into an indentation 26 or snaps into a hole 27 in the bracket.

After the suspension device according to the invention has been mounted in the above-mentioned manner, the shelf 4 or the upper edge of the drawer (not shown) is inserted into the frame, between the flanges 17 and 18 or above the upper flange 17.

Since only one side of each bracket 4 is required in order to carry the frame 14, see FIG. 1, the other side of the bracket can be used to carry another frame, wire shelf or the like.

The above-mentioned fastening of the frame to two brackets, and the torsion resistant arrangement which in this context is achieved when the frame is made of a metal section as stated above, also involves the advantage of the frame with the mounted brackets can be displaced as a unit to an optional location on a pair of supporting elements. If it is desirable to remove the frame from the brackets in order to mount some other structure thereon, for example, a wire shelf, one only needs to prize the locking element 21 loose (by means of a screwdriver or the like) from its engagement with the groove 9, the slot 25 or the hole 27 and displace the frame in a direction opposite to the direction of mounting 22, until the ear/ears 20 has/have got into the second leg 12 of the groove/grooves 9, and lift out the frame 14.

The invention is not limited to that described above or shown in the drawings, but can be modified within the scope of the appended claims.

The invention claimed is:

1. A shelf or drawer system comprising at least two essentially vertically positioned supporting elements with slots or grooves; plate-shaped brackets which are adapted to carry said shelves or drawers and which, by at least one hook-shaped portion protruding from one end of each bracket, are adapted to be inserted into selected slots or grooves for suspension of the brackets from the supporting elements, at least one essentially L-shaped groove being formed in each bracket between its ends and the L-shaped groove having a first leg which extends substantially in a longitudinal direction of the bracket, and a second leg which extends from the first leg and leads to an upper portion of the bracket in its mounted position, a shelf or drawer;

at least one frame which is adapted to carry said shelf or drawer and which frame exhibits a pair of separate and parallel sides with attachments for detachable fastening of the frame to adjacent brackets and at least one connecting portion which connects said sides with one another and which is essentially perpendicular thereto, each attachment comprises at least one ear protruding from the respective said sides and outside the frame, and each ear is adapted to be inserted so that it hooks into the first leg of the associated L-shaped groove;

wherein said attachments also comprise a locking element which protrudes from each side of the frame and which protrudes an essentially shorter distance from the side of the frame than does said ear and which is arranged at a predetermined distance from the ear, which locking element is adapted to snap into an associated groove, indentation or hole in the bracket, when the ear in connection with the mounting of the frame is displaced towards the innermost end of the first leg of said L-shaped groove, for locking of the frame onto the respective brackets;

wherein said ear is a tongue-like element which is punched out in the side of the frame and which substantially extends parallel to the associated side of the frame.

2. The system as claimed in claim 1, wherein the locking element is a wedge-shaped boss which is pressed in the frame with a sliding surface having an inclination, the sliding surface being oriented in the direction of mounting of the frame, and a locking surface having an inclination and being oriented opposite to the direction of mounting of the frame.

3. The system as claimed in claim 1, wherein the locking element is a short peg or stud which is attached to the side of the frame.

4. The system as claimed in claim 1, wherein the locking element is a tongue which protrudes from the frame and is punched out in the side of the frame and which is oriented substantially in the opposite direction relative to said ear.

5. A shelf or drawer system comprising at least two essentially vertically positioned supporting elements with slots or grooves; plate-shaped brackets which are adapted to carry said shelves or drawers and which, by at least one hook-shaped portion protruding from one end of each bracket, are adapted to be inserted into selected slots or grooves for suspension of the brackets from the supporting elements, at least one essentially L-shaped groove being formed in each bracket between its ends and the L-shaped groove having a first leg which extends substantially in a longitudinal direction of the bracket, and a second leg which extends from the first leg and leads to an upper portion of the bracket in its mounted position, a shelf or drawer, at least one frame which includes a surface that is adapted to carry said shelf or drawer in a displaceable manner and which frame exhibits a pair of separate and parallel sides with attachments for detachable fastening of the frame to adjacent brackets and at least one connecting portion which connects said sides with one another and which is essentially perpendicular thereto, each attachment comprises at least one ear protruding from the respective said sides and outside the frame, and each ear is adapted to be inserted so that it hooks into the first lea of the associated L-shaped groove;

wherein said ear is a tongue-like element which is punched out in the side of the frame and which substantially extends parallel to the associated side of the frame;

wherein said attachments further comprise locking elements, one of each of said locking elements protruding perpendicularly from each side of the frame so that the end of each locking element extends a shorter distance away from the side of the frame than does said ear and each of said locking elements is arranged at a predetermined distance from an ear, and, said locking elements adapted to snap into an associated groove, indentation or hole in the bracket, when the ear is disposed at the rearmost end of the first leg of said L-shaped groove, for locking the frame onto the respective brackets.

6. The system as claimed in claim 5, wherein said ear is oriented essentially transversely to the plane of the frame.

7. A system as claimed in claim 6, wherein at least one more ear or pin protrudes from and away from said sides of the frame for fitting into associated grooves or recesses in the upper portion of the brackets in their mounted position.

8. The system as claimed in claim 5, wherein at least one more ear or pin protrudes from and away from said sides of the frame for fitting into associated grooves or recesses in the upper portion of the brackets in their mounted position.

9. The system as claimed in claim 5, wherein the frame is essentially U-shaped, said connecting portion which connects the sides of the frame with one another being arranged adjacent to and between two supporting elements, when the system is mounted.

10. The system as claimed in claim 5, wherein the cross-section of the frame is essentially U-shaped and comprises an upper flange, a lower flange and a web which connects said flanges with one another.

11. The system as claimed in claim 5, wherein at least one more ear or pin protrudes from and away from said sides of the frame for fitting into associated grooves or recesses in the upper portion of the brackets in their mounted position.

12. The system as claimed in claim 5, wherein the frame includes a flange that is adapted to displaceably receive the shelves or drawers.

* * * * *